United States Patent [19]

Cohn, III

[11] Patent Number: 4,956,882

[45] Date of Patent: Sep. 18, 1990

[54] BATH TUB LINER

[76] Inventor: Harold S. Cohn, III, 253 New Jesup Rd., Brunswick, Ga. 31520

[21] Appl. No.: 382,776

[22] Filed: Jul. 19, 1989

[30] Foreign Application Priority Data

Dec. 30, 1988 [JP] Japan ..... 63-335549

[51] Int. Cl.[5] ..... A47K 3/02

[52] U.S. Cl. ..... 4/580; 4/511; 4/582; 4/DIG. 18

[58] Field of Search ..... 4/580–584, 4/575, 661, 511, DIG. 18

[56] References Cited

U.S. PATENT DOCUMENTS

| | | | |
|---|---|---|---|
| 579,532 | 3/1897 | Coe | 4/581 |
| 2,058,188 | 10/1936 | Stanton | 4/575 |
| 2,541,029 | 2/1951 | Burton | 4/573 |
| 3,264,657 | 8/1966 | Klinkner | 4/580 |
| 3,341,866 | 9/1967 | Wright | 4/583 |
| 3,909,859 | 10/1975 | Harris | 4/575 X |
| 3,931,651 | 1/1976 | Weir | 4/580 |
| 4,047,259 | 9/1977 | Lotis | 4/583 X |
| 4,051,563 | 10/1977 | Clarke | 4/575 |
| 4,602,393 | 7/1986 | Fiveash | 4/DIG. 18 |
| 4,630,323 | 12/1986 | Sage et al. | 4/580 |

FOREIGN PATENT DOCUMENTS

| | | | |
|---|---|---|---|
| 2853071 | 6/1980 | Fed. Rep. of Germany | 4/583 |
| 3222174 | 12/1983 | Fed. Rep. of Germany | 4/583 |

*Primary Examiner*—Henry K. Artis

*Attorney, Agent, or Firm*—Thomas C. Saitta

[57] ABSTRACT

A bathtub liner comprising a bottom panel, two lateral panels and an end panel, the panels having a non-slip surface. The lateral panels are substantially rigid and attach to the tub walls by suction cups. Affixed to the lateral panels are support members or handles. The support members are detachable. The support members may also be detachably affixed to the bottom panel.

5 Claims, 2 Drawing Sheets

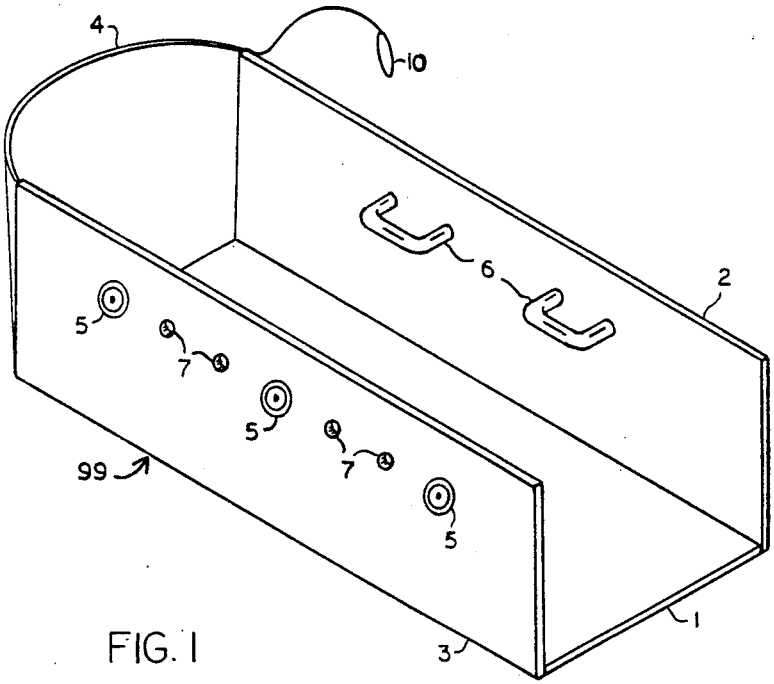
FIG. 1
FIG. 2
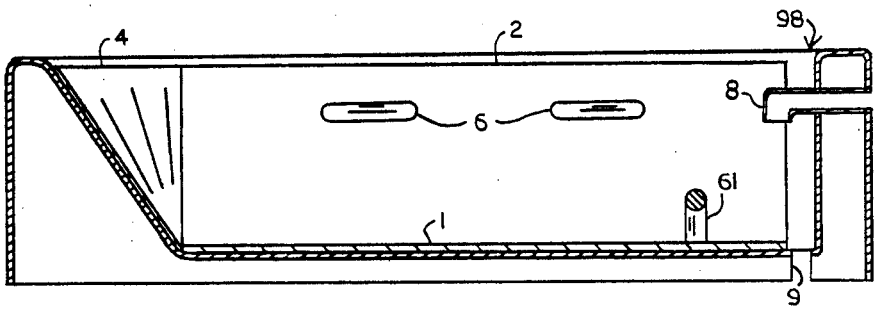

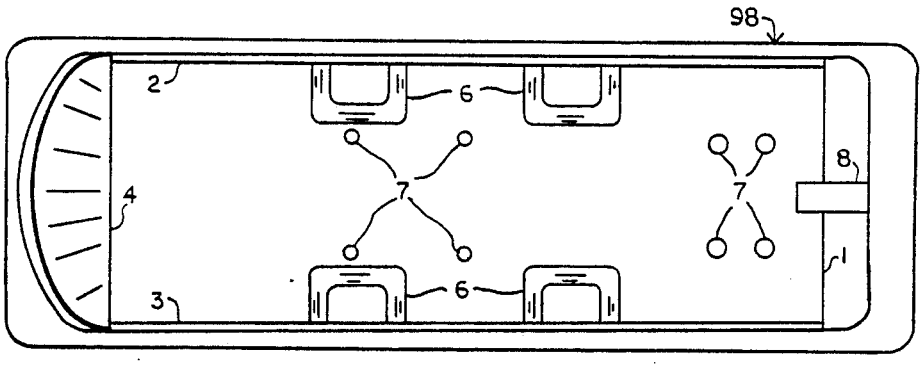
FIG. 3
FIG. 4
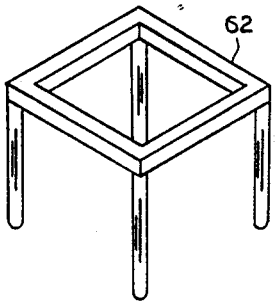

BATH TUB LINER

BACKGROUND OF THE INVENTION

The invention relates to the field of bath tub liners, and more particularly to the field of bath tub liners providing a non-slip surface, shock absorbing material and support handles to assist the user.

Bath tub liners are well known in the art. Bath tubs have hard, smooth surfaces of enamel or the like, and these surfaces become extremely slippery when wet. To prevent injury by accidental slipping on these surfaces, liners are used. In general, they commonly involve non-slip floor mats affixed in place by suction cups. It is also known to provide protective padding on the sides and bottom of the tub itself to absorb the shock of any accidental fall. Examples of these types of liners are shown by Fishman in U.S. Pat. No. 1,759,348 and Rinaldi in U.S. Pat. No. 2,495,602. Fishman teaches a liner mat and attached cushion, the cushion being positioned on the sloping end of the tub to provide comfort for a reclining tub user. The mat and cushion are affixed in place by numerous suction cups. Rinaldi teaches a protective liner comprising a number of pads adapted to cover the sides, ends and bottom of a tub. The individual pads have a non-slip surface and are made of sponge rubber with a water-proof covering, and the vertical pad members are maintained in place by metal U-shaped bracing members.

Such non-slip mats and protective pads are particularly useful in three situations, those being when the tub is used by children, by the elderly or by handicapped individuals. These users are more apt to slip and fall when using the tub. While the known art provides protection against accidental falling, no known devices in this field have been adapted to provide additional means of slip prevention or mobility assistance. The elderly or handicapped may require support or handle means for assistance in getting in or out of the tub, or for adjusting their body position when in the tub itself. Young children and infants are bathed by an adult, and the children often stand in the tub with no attached object to hold onto to provide support and balance.

This invention solves these and additional problems by providing a tub liner with a non-slip surface, padding and support means or handles for use by the elderly, by the handicapped and by children. The liner is firmly attached to the vertical surfaces of the tub and is substantially rigid, with support handles affixed at various locations on the vertical portions. These support handles are used as gripping members by the users to prevent slipping and to increase the ease of body positioning within the tub itself.

An object of this invention is to provide a tub liner having a non-slip surface, protective padding panel members to absorb shock, means to affix the liner to the vertical tub walls and support members attached to the liner.

A further object of the invention is to provide such a liner where the panel members are substantially rigid so as to be relatively non-flexing when in an upright position.

A further object of the invention is to provide detachable support members positionable at various locations on the vertical panel members.

A further object of the invention is to provide receptacles for attachment of the detachable handles at various locations on the bottom panel of the liner.

A further object of the invention is to provide means of affixing the liner to the tub which is detachable and reattachable.

A further object of the invention is to provide a construction so that the liner can be folded flat for storage, with a pocket being formed for support member storage.

BRIEF SUMMARY OF THE INVENTION

The invention is a bath tub liner comprised of three relatively planar, fairly rigid panels and, optionally, a relatively flexible end panel. The three planar panels are substantially rectangular and are each flexibly attached along a long side to one other panel member, thus forming a long U-shaped trough when the outer or lateral panels are positioned upright. When placed in a tub the lateral panels rest adjacent the vertical side walls of the tub, and the central or bottom panel rests on the tub floor. The end panel is trapezoidal or fanshaped and is attached at one end of the liner to each of the lateral and bottom panels. In use the end panel will conform to the curved end of the bath tub. The lateral and bottom panels are made of waterproof material, preferably a soft plastic or rubber, and are textured or ribbed on the interior sides to provide a non-slip surface. The lateral panels are detachably affixed to the tub side walls by a plurality of suction cups. Support handles are attached at locations along the lateral panels. The handles may be removable, in which case handle attachment means or receptacles are provided at locations on the lateral panels. Handle receptacles may also be located at various sites on the bottom panel as well. The particular support handle configuration will vary depending on the particular location and use of each support handle. The liner may be removed from the tub and folded flat, with the end panel forming a pocket for storage of the various support handles.

BRIEF DESCRIPTION OF THE DRAWINGS

FIG. 1 is a perspective view of the tub liner.

FIG. 2 is a longitudinal cross-sectional view of the tub liner in place inside a tub.

FIG. 3 is a vertical view of the tub liner in place inside a tub.

FIG. 4 is a perspective view of the infant support means.

DETAILED DESCRIPTION OF THE INVENTION

The invention is a device constructed to be placed into the interior of a standard bath tub which will provide a protective, non-slip liner for the interior surfaces of the tub, as well as providing handles or similar type support members mounted at various locations for supporting individuals using the tub. The tub liner is composed of water resistant or waterproof materials such as plastic or rubber. Optional interior reinforcing members not contacting water can be composed of any sufficiently rigid material. The support members can be composed of plastic, wood or any other sufficiently rigid material.

With reference now to FIG. 1, the liner 99 is shown freestanding, as it would appear without the surrounding tub. The liner 99 is comprised of a bottom panel 1, two lateral panels 2 and 3, and an end panel 4. Lateral panels 2 and 3, and bottom panel 1 are substantially rectangular in configuration. Each lateral panel 2 and 3 is flexibly attached along their respective bottom edges to a longitudinal edge of bottom panel 1. Lateral panels 2 and 3 and bottom panel 1 can be separately constructed and then joined using suitable webbing material, stitched or adhesively joined. Lateral panels 2 and 3 and bottom panel 1 can also be constructed from a single sheet of suitable material, for example one-quarter inch polyethylene or vinyl, by forming a weak joint line of minimal thickness, so that the joint line acts as a hinge and allows lateral panels 2 and 3 to folded down onto bottom panel 1. End panel 4 has its bottom edge attached to a short edge of bottom panel 1, and each side of end panel 4 is attached to a side of lateral panels 2 and 3, suitable methods of adhesive, stitching or bonding. In this manner, tub liner 99 has a substantially rectangular, box-like configuration with one open end, lateral panels 2 and 3 and end panel 4 being disposed substantially vertically with respect to the horizontal bottom panel 1.

Preferably, bottom panel 1 and lateral panels 2 and 3 are composed of a fairly rigid, slightly flexible, but soft plastic material such as vinyl or polyethylene. The interior surfaces of bottom panel 1 and lateral panels 2 and 3 are preferably textured or ribbed so as to provide a non-slippery surface even when covered with water. Bottom panel 1 and lateral panels 2 and 3 can also be padded for additional shock-absorbency, provided that sufficient rigidity remains for provision of support to the user. Furthermore, reinforcing means may be added to the exterior or formed within the lateral panels 2 and 3 to increase their rigidity and support ability.

A number of suction cups 5, of the type known in the art for application in wet situations, are attached by suitable method to the exterior sides of lateral panels 2 and 3 and various locations. Preferably, suction cups 5 are spaced along the upper portion of lateral panels 2 and 3. Suction cups 5 are used to attach lateral panels 2 and 3 to the side the tub when in use, and must be of sufficient size, strength and number to insure that the lateral panels 2 and 3 will be held firmly in place against the sides of the tub, even when subjected to the weight of a child or adult pulling or pushing against handles 6 which are attached to the interior sides of lateral panels 2 and 3. An additional suction cup 5 may be attached to the exterior side of end panel 4 to secure it to the end portion of the tub.

End panel 4 is preferably composed of a plastic or vinyl material, but as it does not perform any support function, the material is preferably completely flexible and bendable, such as a thin vinyl. End panel 4 may be padded for shock-absorbency, provided that such padding does not significantly decrease the flexibility. The tub liner 99 is constructed such that, when not in use and removed from the tub 98, lateral panels 2 and 3 can be folded down toward bottom panel 1, with end panel 4 forming a pocket. For this purpose, the line of attachment between each lateral panel 2 and 3 and bottom panel 1 must be fully flexible so as to act as a hinge. Tub liner 99 is thus of flat configuration for storage, and support members 6 are storable inside the pocket formed by end panel 4.

Support members 6 are preferably made of a fairly hard and rigid plastic material, but any material suitable for use in wet situations may be utilized. Support members 6 can be permanently attached to lateral panels 2 and 3 by any common method, but preferably are constructed to be detachable. Support member attachment means 7 are disposed at desired locations along lateral panels 2 and 3. These support member attachment means 7 can be of any form suitable for detachably receiving support members 6, provided support members 6 are held with sufficient strength to remain in place when in use, yet are also removable when desired. Preferably, support member attachment means 7 are sockets or receptacles adapted to receive insertion ends of support members 6, maintaining the support members in position by a force fit or snap-interlock configuration. The insertion ends of support members 6 may be tapered, ridged or specially configured to interlock with the support member attachment means 7. The support members 6 are to be used as support or gripping means for small children when standing, providing them with a hand-hold, or for assistance to adults who have difficulty rising from or maneuvering themselves within a tub. These support members 6 are not required to be of any particular shape, but should have no sharp edges or corners and should have a non-slip surface. A preferable configuration for these support members 6 which are attached on the lateral panels 2 and 3 would be C-shaped, thus allowing the user to grip them as a handle.

By providing support member attachment means 7 at various locations, the user can locate the support members 6 at the optimum position for convenience and safety, as determined by the particular use for the liner 99. Furthermore, removal of the support members 6 prior to storage allows the tub liner 99 to be folded flat. Support members 6 plug into the support member attachment means 7 with sufficient affixation that they are only dislodged by a direct, strong pull perpendicular from the lateral panel 2,3 surface. Support members 6 can also be provided with suction means on the ends of the inserted sections which attach to the tub wall for added security. Support member attachment means 7 can also be additionally reinforced, for example by thickening or hardening the plastic material at that location, to insure sufficient support and retention ability.

With reference now to FIG. 2 and FIG. 3, the positioning of tub liner 99 within tub 98 is shown. The open end of tub liner 99 is positioned at the faucet 8 and drain 9 end of tub 98. This allows both entry and exit of the water into and from the tub liner 99. End liner 4 is preferably shaped in the form of a trapezoid or fan-like perimeter, to allow end panel 4 to more closely fit the curved end of tub 98 when the tub liner 99 is in place. The length of the bottom edge of end panel 4 should equal the length of the short end of bottom panel 1, and the length of each vertical edge of end panel 4 should be equal to the length of the vertical edges of lateral panels 2 and 3. The length of the top edge of end panel 4 should be longer than that of the bottom edge to allow end panel 4 to fan out and fit into the curved end of the tub 98.

As shown in FIG. 3, support member attachment means 7 may also be located in bottom panel 1. A headrest support member 61 may be positioned at one or more locations near the open end of tub liner 99, as seen in FIG. 2. This provides a headrest for supporting the head of a child while an adult shampoos its hair, positionable at various distances from faucet 8. The particular shape of this headrest support member 61 should be such that a comfortable support is provided for the user's head. Additionally, support member attachment means 7 can be placed in a pattern in bottom panel 1 to receive specially shaped infant support member or members 62 adapted to provide support for an infant during bathing. The infant support member 62 can comprise a circular or square enclosed perimeter mounted on legs. Such an infant support member 62, as shown in FIG. 4, maintains the infant in an upright, sitting position.

For use in a standard tub, bottom panel 1 is approximately 40" by 18" and lateral panels 2 and 3 are approximately 40" by 11". The end panel 4 is 18" on the bottom edge, 11" on the side edges and 35" on the top edge. Support members 6 and headrest support member 61 can be C-shaped approximately 1" in diameter, 9" in length and 3" in height for use with lateral panels 2 and 3 and as the headrest in bottom panel 1, or the headrest support member 61 can have a flattened upper portion. The infant support members 62 can be specially designed in the shape of a circle having legs 12 inches in length and adapted to fit into the support member attachment means 7 in the bottom panel 1. All sizes and shapes of the support members 6, 61 and 62 are of course a matter of design choice and can be altered to fit particular circumstances.

As an additional convenience to the user, a small blade-like removal device 10 may, be attached by string or chain to the tub liner 99. This removal device 10, preferably made of hard plastic, is used to detach the suction cups 5 from the tub walls. Furthermore, it will also be obvious that the various support member attachment means 7 may also be utilized for attachment of other objects, such as play devices or toys, when not in use for the support members 6.

It will be obvious to those skilled in the art that various substitutions and equivalents are suggested by way of the above descriptions. The illustrations given above are by way of example only, and the true scope and definition of the inventions is to be as set forth in the following claims.

I claim:

1. The combination of a bathtub liner temporarily attachable to the vertical walls of a bathtub and detachable support means attachable to the bathtub liner, where the combination is capable of supporting the weight of a child and assisting an adult in entering or exiting the bathtub, comprising:

a substantially rigid bottom panel;

two substantially rigid lateral panels having suction cups for temporary attachment of the lateral panels to the vertical sides of a bathtub, said lateral panels having sufficient rigidity and thickness to support the weight of a child or an adult entering or exiting the bathtub;

a plurality of support member attachment means, located in said bottom panel and said lateral panels, adapted to detachably retain support members;

said support members adapted to be detachably retained by said support member attachment means;

where said support member attachment means are sockets and said support members have ends which interlock with said sockets;

where the interlock of said support members to said sockets and the attachment of said lateral panels to said bathtub are of sufficient strength to remain intact when subjected to the weight of a child or an adult entering or exiting said bathtub.

2. The combination of claim 1, where said support members are substantially C-shaped.

3. The combination of claim 2, where said support members have suction cups attached to said ends of said support members, whereby said suction cups attach directly to said bathtub.

4. The combination of claim 1, where said support members comprise an enclosed perimeter mounted on legs, where the ends of said legs interlock with said sockets.

5. The combination of claim 4, where said support members have suction cups attached to said ends of said legs, whereby said suction cups attach directly to said bathtub.

* * * * *